US011562718B2

(12) United States Patent
Suzuki

(10) Patent No.: US 11,562,718 B2
(45) Date of Patent: Jan. 24, 2023

(54) KEYBOARD DEVICE FOR KEYBOARD INSTRUMENT

(71) Applicant: KABUSHIKI KAISHA KAWAI GAKKI SEISAKUSHO, Hamamatsu (JP)

(72) Inventor: Akihiro Suzuki, Hamamatsu (JP)

(73) Assignee: KABUSHIKI KAISHA KAWAI GAKKI SEISAKUSHO, Hamamatsu (JP)

( * ) Notice: Subject to any disclaimer, the term of this patent is extended or adjusted under 35 U.S.C. 154(b) by 0 days.

(21) Appl. No.: 17/653,574

(22) Filed: Mar. 4, 2022

(65) Prior Publication Data

US 2022/0293068 A1 Sep. 15, 2022

(30) Foreign Application Priority Data

Mar. 9, 2021 (JP) ..... JP2021-37019

(51) Int. Cl.

| | |
|---|---|
| ***G10C 3/18*** | (2006.01) |
| ***G10H 1/34*** | (2006.01) |
| ***G10C 3/04*** | (2006.01) |

(52) U.S. Cl.

CPC ..... *G10C 3/18* (2013.01); *G10C 3/04* (2013.01); *G10H 1/346* (2013.01); *G10H 2220/221* (2013.01); *G10H 2220/265* (2013.01)

(58) Field of Classification Search

CPC . G10C 3/18; G10C 3/04; G10H 1/346; G10H 2220/221; G10H 2220/265

See application file for complete search history.

(56) References Cited

U.S. PATENT DOCUMENTS

| | | | | |
|---|---|---|---|---|
| 5,406,875 | A * | 4/1995 | Tamai | G10H 1/344 84/719 |
| 7,732,686 | B2 * | 6/2010 | Yamaguchi | G10C 3/12 84/243 |
| 8,927,848 | B2 * | 1/2015 | Kaneko | G10H 1/34 84/720 |
| 9,082,372 | B2 * | 7/2015 | Suzuki | G10C 3/12 |
| 9,940,916 | B2 * | 4/2018 | Suzuki | G10H 1/346 |
| 10,115,382 | B2 * | 10/2018 | Nishimura | G10H 1/346 |

(Continued)

FOREIGN PATENT DOCUMENTS

JP 2008-233825 A 10/2008

*Primary Examiner* — Robert W Horn

(74) *Attorney, Agent, or Firm* — Lewis Roca Rothgerber Christie LLP

(57) ABSTRACT

A keyboard device for a keyboard instrument, capable of obtaining excellent touch feeling and stable key stroke without giving sponge feeling or unpleasant vibration during key depression. The keyboard device includes a keyboard chassis, keys pivotally supported on the chassis, hammers swingably supported on the chassis and swinging along with key depression, a hammer upper limit stopper provided on a chassis rear end and contacted by a hammer rear end from below during key depression, and a key lower limit stopper provided on a chassis front end and contacted by front ends of the keys from above during key depression. The hammer upper limit stopper has predetermined flexibility that allows deformation of the hammer upper limit stopper such that after contact of a hammer during key depression, an associated key reaches its lowest position in a state in contact with the key lower limit stopper.

4 Claims, 4 Drawing Sheets

(56) References Cited

U.S. PATENT DOCUMENTS

| | | | | |
|---|---|---|---|---|
| 10,902,830 | B2 * | 1/2021 | Nishida | G10H 7/02 |
| 11,037,542 | B2 * | 6/2021 | Okamoto | G10H 1/346 |
| 11,508,341 | B2 * | 11/2022 | Suzuki | G10C 3/18 |
| 2020/0074968 | A1 * | 3/2020 | Suzuki | G10C 3/12 |
| 2020/0265818 | A1 * | 8/2020 | Okamoto | G10H 1/346 |
| 2022/0084484 | A1 * | 3/2022 | Suzuki | G10H 1/344 |
| 2022/0293068 | A1 * | 9/2022 | Suzuki | G10H 1/346 |

* cited by examiner

KEYBOARD DEVICE FOR KEYBOARD INSTRUMENT

CROSS-REFERENCE TO RELATED APPLICATION(S)

This application claims priority to Japanese Patent Application Number 2021-37019, filed on Mar. 9, 2021, the entire content of which is incorporated herein by reference.

BACKGROUND OF THE INVENTION

Field of the Invention

The present invention relates to a keyboard device for a keyboard instrument including a hammer which is used for an electronic piano or the like, and is configured to swing in a manner interlocked with depression of an associated key.

Description of the Related Art

Conventionally, as this kind of a keyboard device for a keyboard instrument, there has been known, for example, one disclosed in Japanese Laid-Open Patent Publication (Kokai) No. 2008-233825. This keyboard device includes a key frame made of a synthetic resin, a plurality of keys each extending in a front-rear direction and disposed in a state arranged side by side in the left-right direction with respective rear ends thereof pivotally supported on the key frame, and a plurality of swing levers provided below the keys, each extending in the front-rear direction and swingably supported on the key frame on a key-by-key basis in a state arranged side by side in the left-right direction. The swing levers swing in a manner interlocked with depression of associated ones of the keys. Each key has a drive section protruding downward from a front end thereof. A lower end of the drive section is engaged with a predetermined portion of an associated one of the swing levers, which is located forward of a swing support of the swing lever. Further, upper limit stopper members, which are contacted from below by rear ends of the swing levers moved upward by depression of the keys, are provided on a rear end of the key frame, whereas key stoppers are provided on a front end of the key frame.

In the keyboard device constructed as above, when a front end of one of the keys is pressed down by key depression, causing pivotal movement of the key, a front end of an associated one of the swing levers is pressed down by the drive section of the key, and a rear end thereof swings such that it moves upward. During musical performance, when key depression is performed e.g. by a relatively weak force (in the present specification, hereinafter referred to as "the soft key striking" as deemed appropriate), the rear end of the swing lever moves into contact with an associated one of the upper limit stopper members, whereby the swing of the swing lever is stopped, since an elastic force of the upper limit stopper member is stronger than a force generated by the key depression (in the present specification, hereinafter referred to as "the key depression force" as deemed appropriate). In accordance therewith, the pivotal motion of the depressed key is stopped, whereby further pressing down of the front end of the key is blocked. That is, the key depressed by the soft key striking is blocked from being pressed down without moving into contact with an associated one of the key stoppers.

On the other hand, if key depression largely exceeding the key depression force generated by the above-mentioned soft key striking (in the present specification, hereinafter referred to as "the hard key striking" as deemed appropriate) and key depression by a key depression force between that of the soft key striking and that of the hard key striking (in the present specification, hereinafter referred to as "the medium key striking" as deemed appropriate) are performed, since the key depression forces exceed the elastic force of the upper limit stopper member, the front end of the depressed key moves into contact with the key stopper, whereby the pivotal motion of the key is stopped, and the key is blocked from being further pressed down.

In general, the keyboard device of the above-described type is configured such that before the key contacts the key stopper, the swing lever contacts the upper limit stopper member. This is because if the key contacts the key stopper before the swing lever contacts the upper limit stopper member, the swing lever becomes temporarily free with respect to the key, whereby unnecessary vibration is generated, and it is necessary to prevent generation of the unnecessary vibration. However, during musical performance, when key depression is performed by the medium key striking or the hard key striking, a so-called sponge feeling (feeling of sinking further from a key pressing position at which the swing lever contacts the upper limit stopper member) is given as a touch feeling felt at a fingertip during pressing down the key to its lowest position.

Further, depending on the construction of the upper limit stopper member, when the swing lever is brought into contact with the upper limit stopper member by key depression, a relatively strong repulsive force sometimes acts on the swing lever as a reaction force against the contact. In this case, the repulsive force is transmitted from the swing lever to the depressed key. As a result, unpleasant vibration is given to the fingertip. Furthermore, when repeated contact of the swing lever with the upper limit stopper member causes deformation of a contact portion of the upper limit stopper member into a portion remaining in a dented state, a swing angle of the swing lever is increased by an amount corresponding to the dented state at the time of key depression by the soft key striking during which a key stroke (vertical movable length of the front end of the key) is determined by the upper limit stopper member, whereby the key stroke changes to become progressively longer.

SUMMARY OF THE INVENTION

It is an object of the present invention to provide a keyboard device for a keyboard instrument, which is capable of obtaining an excellent touch feeling and a stable key stroke without giving a sponge feeling or unpleasant vibration during key depression.

To attain the above object, the present invention provides a keyboard device for a keyboard instrument, including a keyboard chassis, a plurality of keys each extending in a front-rear direction and having a rear end pivotally supported on the keyboard chassis, the keys being arranged side by side in a left-right direction, a plurality of hammers each extending in the front-rear direction and swingably supported on the keyboard chassis below the plurality of keys in association with the respective keys, the hammers being arranged side by side in the left-right direction, each for imparting a touch weight to an associated one of the keys while swinging in a manner interlocked with depression of the associated key, a hammer upper limit cushion provided on a rear end of the keyboard chassis in a manner protruding downward therefrom above the plurality of hammers, the hammer upper limit cushion being contacted, in accordance with depression of one of the keys, from below by a rear end of one of the hammers, which is associated with the depressed key, and a key lower limit cushion provided on a front end of the keyboard chassis, the key lower limit cushion being contacted in accordance with the depression of the one of the keys, from above by a front end of the depressed key, wherein the hammer upper limit cushion is configured to have a predetermined flexibility that allows deformation of the hammer upper limit cushion itself such that after the hammer associated with the depressed key has been brought into contact with the hammer upper limit cushion by key depression, the key associated with the hammer reaches its lowest position in a state in contact with the key lower limit cushion, and wherein the key lower limit cushion is formed to be harder than the hammer upper limit cushion.

With this construction, e.g. during musical performance of the keyboard instrument, when a front end of a key is pressed down by key depression by a player, the key pivotally moves forward and downward using a rear end thereof as a pivot, and in a manner interlocked with the pivotal motion of the key, a hammer associated with the key swings. In this case, a rear end of the hammer moves into contact with the hammer upper limit cushion provided on the rear end of the keyboard chassis from below. After this contact, the depressed key reaches its lowest position in a state in which the front end thereof is in contact with the key lower limit cushion provided on the front end of the keyboard chassis from above.

The above-described hammer upper limit cushion has a predetermined flexibility, i.e. a flexibility that allows deformation of the hammer upper limit cushion itself such that after contact of the hammer with the hammer upper limit cushion, the key associated with the hammer reaches its lowest position in a state in contact with the key lower limit cushion. Therefore, during key depression, a strong repulsive force is prevented from acting on the hammer brought into contact with the hammer upper limit cushion, whereby differently from the conventional keyboard device, no repulsive force from the hammer is transmitted to the key by the key depression, and therefore, the key can be firmly pressed down to the lowest position in the state in contact with the key lower limit cushion. As a consequence, the sponge feeling or unpleasant vibration as given by the conventional keyboard device is prevented from being given to the player. Further, the above-described key lower limit cushion is formed to be harder than the hammer upper limit cushion, and irrespective of the magnitude of a key depression force for depressing the key, the depressed key always reaches its lowest position in the state where the front end thereof is in contact with the key lower limit cushion. Thus, the key that has reached the lowest position by key depression does not pivotally move further downward, and the key stroke of the key is held constant. As described above, according to the keyboard device of the present invention, when the key is depressed, it is possible to obtain an excellent touch feeling and a stable key stroke without giving the above-mentioned sponge feeling or unpleasant vibration to the player.

Preferably, each of the plurality of keys is configured such that also when the key is depressed with a key depression load that is equal to or smaller than a predetermined value and allows the hammer associated with the key to swing, the depressed key reaches its lowest position in the state in contact with the key lower limit cushion.

With the construction of this preferred embodiment, each of the plurality of keys reaches its lowest position in the state in contact with the key lower limit cushion, not only when the key is pressed with a key depression load larger than the predetermined value but also when the key is pressed with a key depression load that is equal to or smaller than the predetermined value and allows the associated hammer to swing, i.e. when the key is pressed down with such a relatively weak force (soft key striking) that allows the hammer to swing. As described above, according to the present invention, not only when the key is depressed with a strong force but also when the key is depressed with a relatively weak force, the key reaches its lowest position in the state in contact with the key lower limit cushion, and hence it is possible to excellently obtain the same advantageous effects as described above during operation of all the keys of the keyboard device irrespective of playing methods dependent on strengths of key depression forces.

More preferably, wherein the predetermined value is 300 g.

With the construction of this preferred embodiment, even when the key is depressed with a weak force of 300 g or less, i.e. by the soft key striking, as described hereinafter, the key reaches its lowest position in the state in contact with the key lower limit cushion. Even when the key is depressed by the soft key striking as mentioned above, it is possible to excellently obtain the above-described advantageous effects.

Preferably, the hammer upper limit cushion is formed of a low-repulsion polyurethane foam mounted on the keyboard chassis and a felt provided on a lower surface of the low-repulsion polyurethane foam, and is provided such that the hammer upper limit cushion extends in the left-right direction along an entirety of the plurality of hammers, and the key lower limit cushion is formed of a high-density polyurethane foam mounted on the keyboard chassis and a felt provided on an upper surface of the high-density polyurethane foam, and is provided such that the key lower limit cushion extends in the left-right direction along an entirety of the plurality of keys.

In general, the low-repulsion polyurethane foam has characteristics of being relatively soft and having high impact absorption and high vibration-damping properties as well as having a very small repulsive force against pressing while having restorability. On the other hand, the high-density polyurethane foam has characteristics of being relatively hard and having a high shape retaining property over a long term. With the construction of this preferred embodiment, the hammer upper limit cushion includes the low-repulsion polyurethane foam having the above-described characteristics, and therefore, when the hammer is brought into contact with the hammer upper limit cushion for pressing the same by key depression, the low-repulsion polyurethane foam is easily deformed, whereby it is possible to suppress a repulsive force against the hammer. Further, the key lower limit cushion includes the high-density polyurethane foam having the above-mentioned characteristics, and hence when the key is depressed, the front end of the key is blocked from further downward movement immediately after moving into contact with the key lower limit cushion, and reaches the lowest position of the key.

Further, in the hammer upper limit cushion, the low-repulsion polyurethane foam is mounted on the keyboard chassis, and the felt is provided on the lower surface of the low-repulsion polyurethane foam, i.e. on a side toward the hammer. On the other hand, in the key lower limit cushion, the high-density polyurethane foam is mounted on the keyboard chassis, and the felt is provided on the upper surface of the high-density polyurethane foam, i.e. on a side toward the key. In general, since the felt has high impact absorption and high sound absorption, in a case where the hammer contacts the hammer upper limit cushion or the key contacts the key lower limit cushion, it is possible to reduce the impacts of the hammer and the key generated by the contacts and prevent noise from being generated, because it is the felt that the hammer and the key directly are brought into contact with.

Furthermore, the hammer upper limit cushion extends in the left-right direction along the entirety of the plurality of hammers, and the key lower limit cushion extends in the left-right direction along the entirety of the plurality of keys. For this reason, when the hammer upper limit cushion and the key lower limit cushion are mounted on the keyboard chassis, it is possible to mount them more efficiently compared with a case where each of the hammer upper limit cushion and the key lower limit cushion is mounted one by one on each associated hammer or key.

The above and other objects, features, and advantages of the present invention will become more apparent from the following detailed description taken in conjunction with the accompanying drawings.

BRIEF DESCRIPTION OF THE DRAWINGS

FIGS. 1A to 1C are diagrams showing a keyboard device for an electronic piano according to an embodiment of the present invention, in a key-released state, in which FIG. 1A is a side view of the keyboard device including a white key as an essential component, FIG. 1B is an enlarged side view of the keyboard device including a key lower limit stopper as an essential component, and FIG. 1C is an enlarged side view of the keyboard device including a hammer upper limit stopper as an essential component;

FIGS. 5A and 5B are diagrams showing static load curves which represent a relationship between key stroke and key depression load at the time of key depression, in which FIG. 5A shows an example in which the keyboard device according to the present embodiment is used, and FIG. 5B shows a comparative example in which a conventional keyboard device is used.

DETAILED DESCRIPTION OF PREFERRED EMBODIMENTS

Figure 1A:
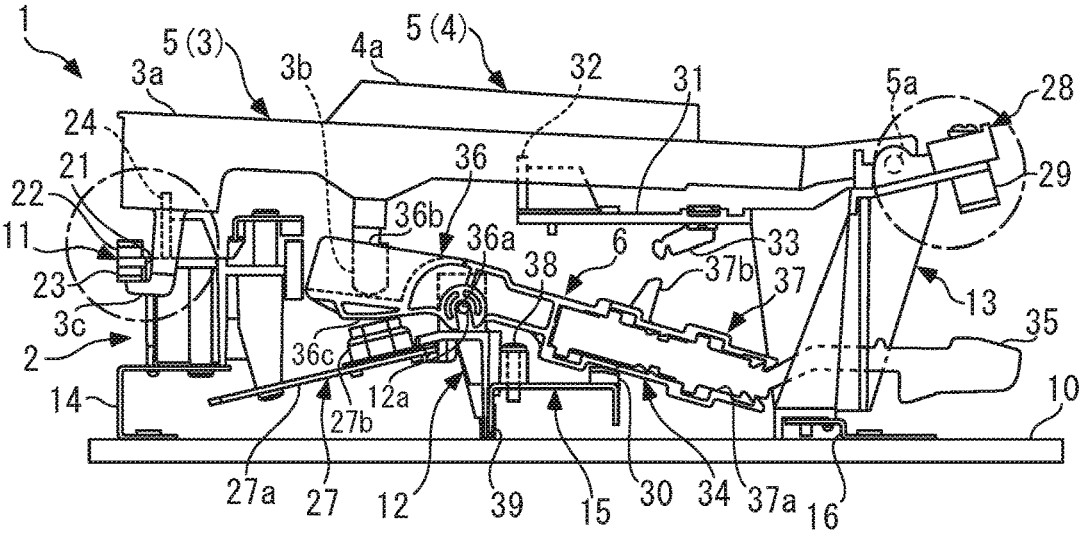
Figure 2:
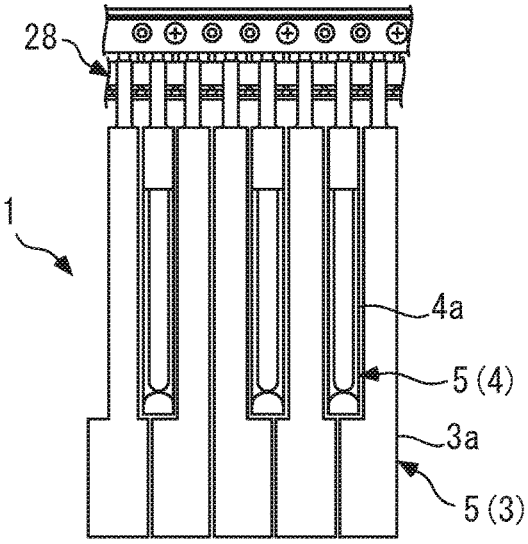
FIG. 2 is a plan view of a portion of the keyboard device.

The present invention will now be described in detail with reference to the drawings showing preferred embodiments thereof. FIGS. 1A and 2 show a keyboard device for an electronic piano according to an embodiment of the present invention. As shown in FIGS. 1A and 2, the keyboard device 1 is comprised of a keyboard chassis 2, a plurality of keys 5 (e.g. eighty-eight keys) which include white keys 3 and black keys 4 (only five white keys and three black keys are shown in FIG. 2) and are pivotally mounted on the keyboard chassis 2, and a plurality of hammers 6 (only one of which is shown in FIG. 1A) each swingably mounted on the keyboard chassis 2 for an associated one of the keys 5. Note that in the following description, if the white keys 3 and the black keys 4 are not particularly distinguished from each other, they will be simply referred to as "the keys 5".

The keyboard chassis 2 is formed by a plurality of molded articles arranged in parallel with each other in a left-right direction (in a depth direction in FIG. 1A and in a left-right direction in FIG. 2), which are made e.g. by injection molding of a predetermined resin material (e.g. an ABS resin) into a predetermined shape for each octave. Referring to FIG. 1A, the keyboard chassis 2 has a front portion (left portion as viewed in FIG. 1A) 11, an intermediate portion 12, and a rear portion (right portion as viewed in FIG. 1A) 13 integrally formed with each other in a state connected to each other by ribs, not shown. Further, the front portion 11, the intermediate portion 12, and the rear portion 13 have their plurality of molded articles of the keyboard chassis 2 made for each octave, connected to each other via a front-side rail 14, an intermediate rail 15, and a rear-side rail 16, which extend in the left-right direction (in the depth direction in FIG. 1A), respectively. In addition, the front portion 11 and the rear portion 13 are fixed to a keybed 10 via the front-side rail 14 and the rear-side rail 16, respectively. Note that in the following description, the front portion 11, the intermediate portion 12, and the rear portion 13 of the keyboard chassis 2 are referred to as "the chassis front 11", "the chassis intermediate portion 12", and "the chassis rear 13", respectively.

Figure 1B:
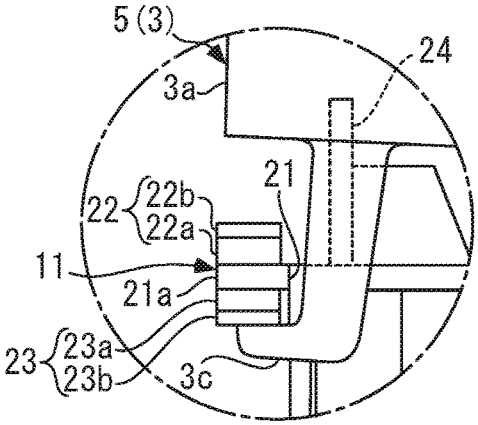

The chassis front 11 is formed with a plurality of pairs of engagement holes 21 provided for each associated one of the white keys 3, each pair being formed by two engagement holes 21 left and right (only one of which is shown in FIGS. 1A and 1B) vertically extending through the chassis front 11. Left and right upper limit position regulation portions 3*c*, referred to hereinafter, of the associated white key 3 are engaged with the engagement holes 21 in a state inserted therethrough respectively.

Further, as shown in FIGS. 1A and 1B, the chassis front 11 has a key lower limit stopper 22 (key lower limit cushion) and a key upper limit stopper 23 mounted on respective upper and lower surfaces of an edge 21*a* thereof forward of the engagement holes 21. The key lower limit stopper 22 is provided for restricting the lower limit position of each white key 3 during depression of the white key 3. The key lower limit stopper 22 is formed of a high-density polyurethane foam 22*a*, which is mounted on the upper surface of the above-mentioned edge 21*a* of the chassis front 11, and a felt 22*b* provided on an upper surface of the high-density polyurethane foam 22*a*, and is formed into a single band extending in the left-right direction along an entirety of a plurality of the white keys 3 arranged side by side in the left-right direction.

The above-mentioned high-density polyurethane foam 22*a* has characteristics of being relatively hard and having a high shape retaining property over a long term. On the other hand, the felt 22*b* has characteristics of having high impact absorption and high sound absorption. Further, in the key lower limit stopper 22, the high-density polyurethane foam 22*a* has a predetermined thickness in the vertical direction, and the felt 22*b* has a thickness smaller than the predetermined thickness.

On the other hand, the key upper limit stopper 23 is provided for restricting the upper limit position of each white key 3 during key release. The key upper limit stopper 23 is disposed in symmetrical relation to the above-mentioned key lower limit stopper 22 in the vertical direction. That is, the key upper limit stopper 23 is formed of a high-density polyurethane foam 23*a*, which is mounted on a lower surface of the above-mentioned edge 21*a* of the chassis front 11, and a felt 23*b* provided on a lower surface of the high-density polyurethane foam 23*a*.

Further, the chassis front 11 has a plurality of white key-associated key guides 24 (only one of which is shown in FIG. 1A) erected therefrom in association with the respective white keys 3 so as to vertically guide each white key 3 and prevent lateral swing of the same during pivotal motion thereof. The white key-associated key guides 24 each have approximately the same width as the lateral inner width (width in the left-right direction) of an associated one of the white keys 3, and is inserted into the white key 3 opening downward from below.

The chassis intermediate portion 12 has a support shaft 12*a* extending in the left-right direction, and the hammers 6 are swingably supported on the support shaft 12*a*. Further, key switches 27 extending toward the chassis front 11 are mounted on the chassis intermediate portion 12, for each detecting key depression information on an associated one of the keys 5. The key switches 27 are formed by a printed circuit board 27*a* and switch bodies 27*b* formed by rubber switches attached to the printed circuit board 27*a* on a key-by-key basis. The key switches 27 are mounted on the keyboard chassis 2 in a state in which a rear end of the printed circuit board 27*a* is inserted into the chassis intermediate portion 12 and a front end of the same is screwed to the chassis front 11.

The chassis rear 13 has a key support section 28 that supports pivot shafts 5*a* provided on a rear end of each key 5, to thereby support the key 5 such that the key 5 is pivotally movable about the axis of the pivot shafts 5*a*. Further, a hammer upper limit stopper 29 (hammer upper limit cushion) that protrudes downward above an associated one of the hammers 6 is attached to a rear end of a lower surface of the key support section 28.

Figure 1C:
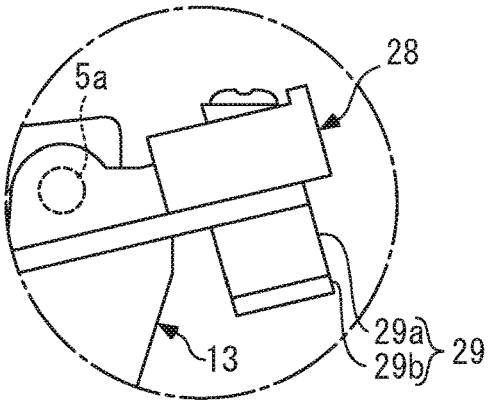

The hammer upper limit stopper 29 is contacted by a rear end of the associated hammer 6 swung by key depression. As shown in FIG. 1C, the hammer upper limit stopper 29 is formed of a low-repulsion polyurethane foam 29*a*, which is mounted on a lower surface of the key support section 28, and a felt 29*b* provided on a lower surface of the low-repulsion polyurethane foam 29*a*, and is formed into a single band extending in the left-right direction along an entirety of the hammers 6 arranged side by side in the left-right direction.

The above-mentioned low-repulsion polyurethane foam 29*a* has characteristics of being relatively soft and having high impact absorption and a high vibration-damping property as well as having a very small repulsive force against pressing while having restorability. On the other hand, the felt 29*b* has the same characteristics as the above-mentioned felt 22*b* of the key lower limit stopper 22. Further, in the hammer upper limit stopper 29, the low-repulsion polyurethane foam 29*a* has a relatively large predetermined thickness in the vertical direction, and the felt 29*b* has a thickness smaller than the predetermined thickness. Note that the above-mentioned high-density polyurethane foam 22*a* of the key lower limit stopper 22 is formed to be harder than the low-repulsion polyurethane foam 29*a* of the hammer upper limit stopper 29.

Between the chassis rear 13 and the chassis intermediate portion 12, there is provided a flat plate 31 extending substantially horizontally between the keys 5 and the hammers 6. This flat plate 31 has a plurality of black key-associated key guides 32 (only one of which is shown in FIG. 1A) erected on a front end thereof in association with the respective black keys 4 so as to vertically guide each black key 4 and prevent lateral swing of the same during pivotal motion thereof. Similar to the above-described white key-associated key guides 24, the black key-associated key guides 32 each have approximately the same width as the lateral inner width of an associated one of the black keys 4, and is inserted into the black key 4 opening downward from below.

Note that let-off members 33 each formed of an elastic material are mounted on the flat plate 31 in association with the respective hammers 6 in a manner protruding obliquely downward and forward from a lower surface of the flat plate 31. These let-off members 33 are provided each for imparting let-off feeling to the touch feeling of a depressed key 5, by one of the hammers 6 that swings in a manner interlocked with depression of the key 5 being temporarily engaged with the let-off member 33 during swing of the hammer 6.

Each key 5 is formed e.g. by injection molding of a predetermined resin material (e.g. AS resin) such that it extends in a front-rear direction and has an inverted U shape opening downward in cross-section. Further, the key 5 has a key body (key body 3*a* of the white key 3 or key body 4*a* of the black key 4) which is pivotally movably supported on the keyboard chassis 2 such that the key body can be pivotally moved about the axis of the pivot shafts 5*a* protruding from the left and right sides of the rear end thereof.

As shown in FIG. 1A, the white key 3 has an actuator portion 3*b*, which protrudes downward over a predetermined length, at a predetermined location forward of a central portion of the key body 3*a* in the front-rear direction. The actuator portion 3*b* is engaged with an engagement recess 36*b*, referred to hereinafter, of the hammer 6 in a state received therein. Further, the white key 3 has the pair of left and right upper limit position regulation portions 3*c* and 3*c* (only one of which is shown in FIGS. 1A and 1B) which protrude downward from a front end of the key body 3*a* over a predetermined length and each have a lower end thereof bent forward. The upper limit position regulation portions 3*c* and 3*c* are engaged with associated ones of the engagement holes 21 and 21 formed through the chassis front 11 in a state inserted therethrough.

On the other hand, the black key 4 has an actuator portion (not shown), which protrudes downward from a front end of the key body 4*a* over a predetermined length. Similar to the actuator portion 3*b* of the white key 3, the actuator portion of the black key 4 is engaged with the associated engagement recess 36*b* of the hammer 6 in a state received therein.

As shown in FIG. 1A, the hammer 6 is comprised of a hammer body 34 and a weight 35 removably attached thereto. The hammer body 34 is formed as a resin molded article which is made e.g. by injection molding of a predetermined resin material (e.g. polyacetal resin) into a predetermined shape. The hammer body 34 extends in the front-rear direction, and has a bearing portion 36*a* formed at a predetermined location in a front half (left half, as viewed in FIG. 1A) 36 of the hammer body 34. The bearing portion 36*a* has an inverted U shape open downward in side view, and is pivotally movably engaged with the support shaft 12*a* of the chassis intermediate portion 12.

Further, the engagement recess 36*b* for engagement with the actuator portion 3*b* of the white key 3 is formed in a front half 36 of the hammer body 34 at a location forward of the bearing portion 36*a*. The engagement recess 36*b* is open upward and forward, and receives the actuator portion 3*b* in a state in which a lower end of the actuator portion 3*b* of the white key 3 is in contact with a bottom surface of the engagement recess 36*b*. Furthermore, the front half 36 of the hammer body 34 is formed with a switch pressing portion 36*c* below the engagement recess 36*b*, for pressing the switch body 27*b* of the key switch 27.

A weight mounting portion 37 forming a rear half of the hammer body 34 has an opening 37*a* open rightward (toward the near side as viewed in FIG. 1A), and the weight 35 is removably mounted on the hammer body 34 via the opening 37*a*. Further, an engagement protrusion 37*b* for engagement with the above-described let-off member 33 by key depression is formed on the weight mounting portion 37 of the hammer body 34 at a predetermined location in a manner protruding upward from the weight mounting portion 37.

On the other hand, the weight 35 is formed of a material (metal such as steel) larger in specific gravity than the hammer body 34. The weight 35 is formed e.g. by pressing and stamping a metal plate having a smaller thickness than the thickness of the hammer body 34 (thickness in the depth direction as viewed in FIG. 1A) into a predetermined shape. The weight 35 extends in the front-rear direction, with a front half thereof mounted to the weight mounting portion 37 of the hammer body 34 and a rear half thereof extending rearward to the vicinity of a rear end of the chassis rear 13.

Further, the intermediate rail 15 is mounted on the chassis intermediate portion 12 of the keyboard chassis 2 below the support shaft 12*a* about which the hammer 6 swings and its vicinity. The intermediate rail 15 is formed in a C shape opening downward in transverse cross-section. Further, the intermediate rail 15 is screwed to the chassis intermediate portion 12 by a mounting screw 38 in a state in which a wall of the intermediate rail 15, formed on a front end thereof (hereinafter referred to as "the front wall"), is in intimate contact with a wall of the chassis intermediate portion 12, formed on a rear end thereof in a drooping manner (hereinafter referred to as "the drooping wall"). Furthermore, the front wall of the intermediate rail 15 is sandwiched in the front-rear direction between the drooping wall 12*b* of the chassis intermediate portion 12 and a clip member 39 fitted from below. Note that the clip member 39 is made of rubber or synthetic resin and is configured such that vibration from the chassis intermediate portion 12 toward the keybed 10 can be suppressed.

Further, a hammer lower limit stopper 30 for restricting the lower limit position of the hammer 6 is mounted on a rear end (right end as viewed in FIG. 1A) of an upper surface of the intermediate rail 15, along the longitudinal direction of the intermediate rail 15 (in the depth direction as viewed in FIG. 1A) and also along the entirety of the plurality of hammers 6. Similar to the above-described hammer upper limit stopper 29, the hammer lower limit stopper 30 is formed of a low-repulsion polyurethane foam and a felt such that it has a predetermined thickness. The felt is disposed on an upper side of the hammer lower limit stopper 30 (toward the hammer 6).

Figure 3A:
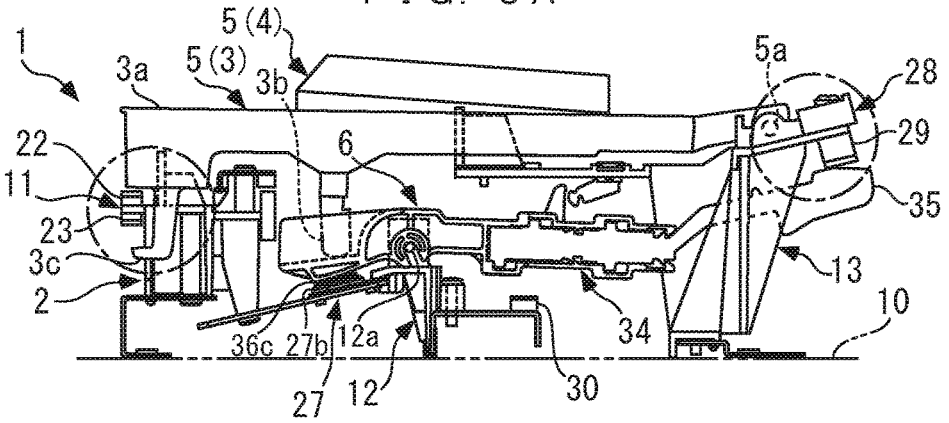
FIGS. 3A to 3C are views corresponding to FIGS. 1A to 1C, respectively, which are useful in explaining operation of the keyboard device at the time of key depression, and show a state immediately after a hammer has moved into contact with the hammer upper limit stopper.

In the keyboard device 1 constructed as above, when the key 5 is depressed from the key-released state shown in FIGS. 1A, 1B and 1C, e.g. as shown in FIG. 3A in which one of the white keys 3 is depressed, the white key 3 having a front end thereof pressed down is pivotally moved in a counterclockwise direction about the axis of the pivot shafts 5*a* of the rear end thereof. In accordance with this pivotal motion of the white key 3, the actuator portion 3*b* of the white key 3 presses downward the engagement recess 36*b* of the hammer 6. As a consequence, the hammer 6 presses the associated switch body 27*b* of the key switch 27 from above by the switch pressing portion 36*c* while swinging in the counterclockwise direction about the axis of the support shafts 12*a* of the chassis intermediate portion 12.

Figure 3B:
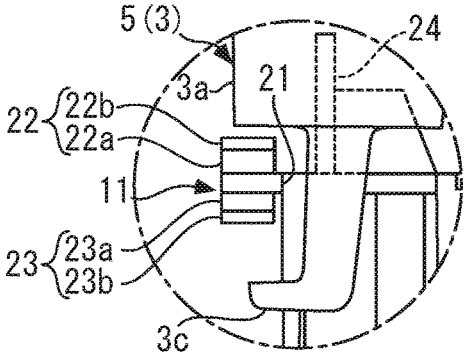
Figure 3C:
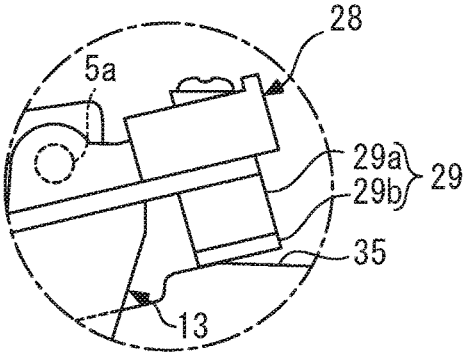

Further, in this case, a rear end of the hammer 6 (a rear end of the weight 35) moves into contact with the hammer upper limit stopper 29 of the chassis rear 13 from below. During this contact, as shown in FIG. 3B, a lower end of the front end of the key body 3*a* of the white key 3 has not been brought into contact with the key lower limit stopper 22 yet.

Figure 4A:
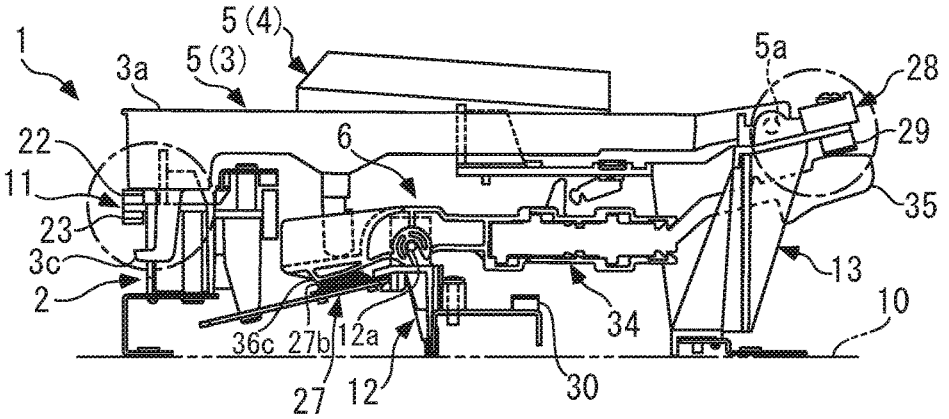
FIGS. 4A to 4C are views corresponding, respectively, to FIGS. 1A to 1C, which are useful in explaining operation of the keyboard device at the time of key depression, continued from FIGS. 3A to 3C, and show a state immediately after the white key has moved into contact with the key lower limit stopper.
Figure 4B:
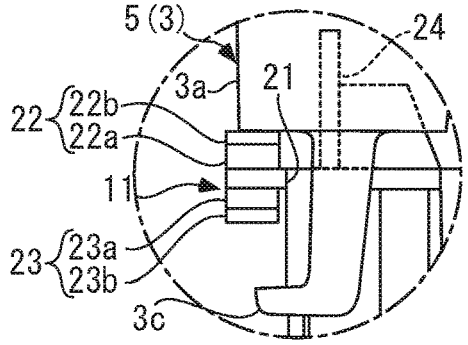
Figure 4C:
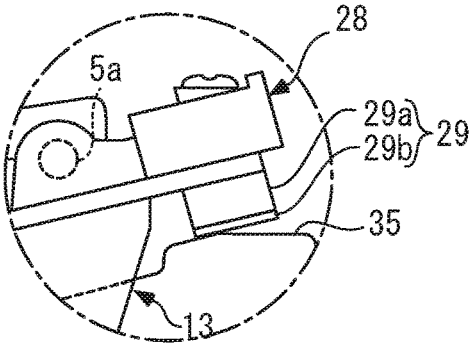

When the white key 3 is further pressed down, as shown in FIGS. 4A and 4C, the hammer 6 further swings in the counterclockwise direction about the support shaft 12*a*, and further presses the switch body 27*b*. The hammer upper limit stopper 29 is deformed by being pressed from below. Further, in this case, as shown in FIGS. 4A and 4B, the key body 3*a* of the white key 3 has the lower end of the front end thereof brought into contact with the key lower limit stopper 22 from above, and further downward movement of the key body 3*a* is blocked, whereby the key body 3*a* reaches its lowest position. That is, the white key 3 has been placed into a fully depressed state.

In the state in contact with the key lower limit stopper 22, the white key 3 is in the fully depressed state as described above, not only in the above-described case where key depression is performed by medium key striking or hard key striking but also in a case where key depression is performed by soft key striking. Note that a boundary value with reference to which whether the striking is the soft key striking or the medium key striking is determined can be set to e.g. 300 g, and therefore, key depression by a force of 300 g or less is determined as the soft key striking.

After the above-mentioned full depression of the white key 3, when the finger is released from the white key 3, the hammer 6 swings in a clockwise direction about the support shaft 12*a*, and in accordance therewith, the white key 3 is pushed upward by the engagement recess 36*b* of the hammer 6 via the actuator portion 3*b*. In this case, a predetermined portion of the hammer body 34 of the hammer 6 moves into contact with the hammer lower limit stopper 30 from above, and the left and right upper limit position regulation portions 3*c* of the white key 3 moves into contact with the key upper limit stopper 23 from below. As a consequence, the pivotal motion of the white key 3 and the swing of the hammer 6 are stopped, and the white key 3 and the hammer 6 return to their original key-released states shown in FIGS. 1A, 1B and 1C.

Figure 5A:
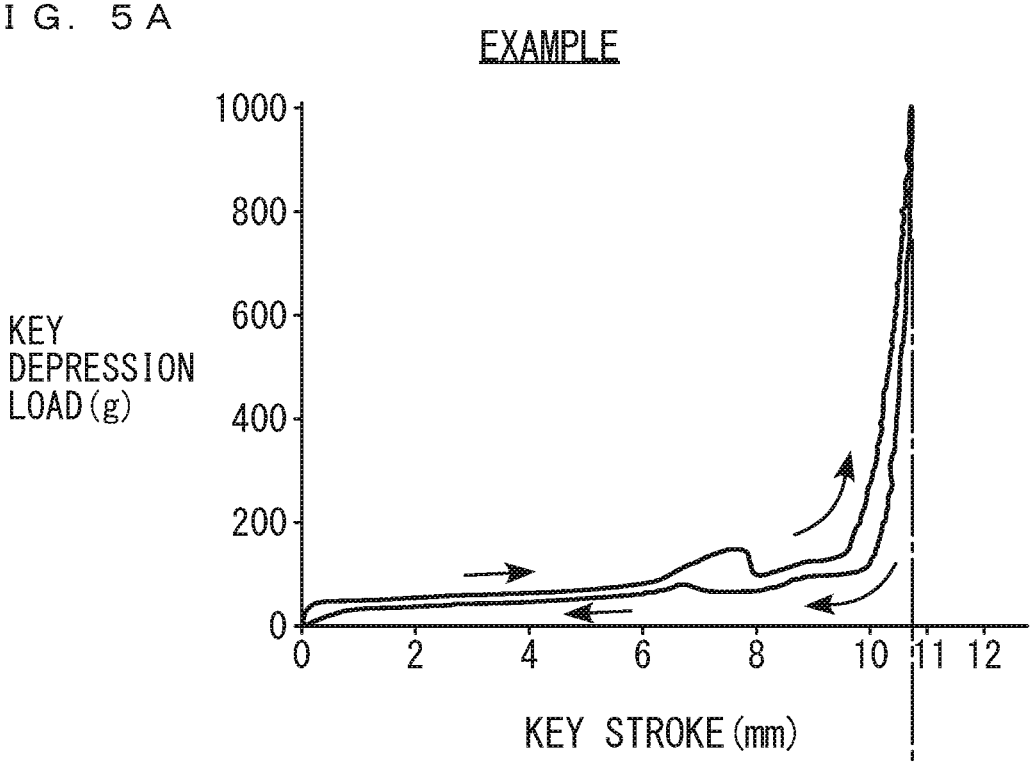
Figure 5B:
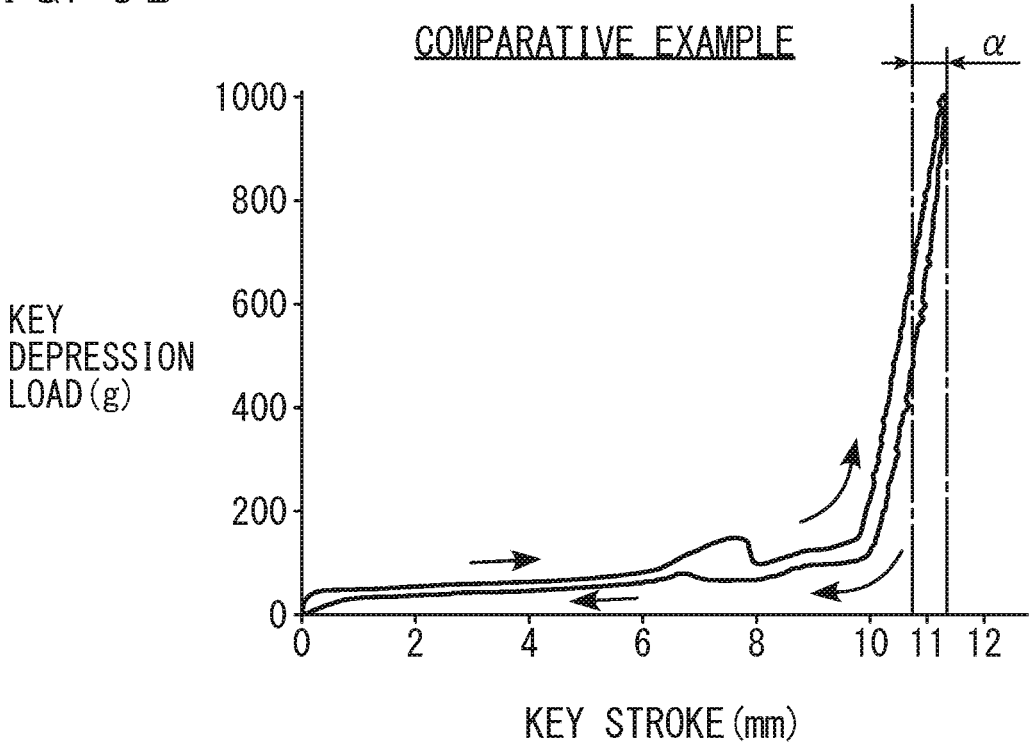

FIGS. 5A and 5B are diagrams showing static load curves which represent a relationship between key stroke and key depression load generated by key depression. FIG. 5A shows an example in which the keyboard device 1 according to the present embodiment is used, and FIG. 5B shows a comparative example in which the conventional keyboard device is used. Note that the conventional keyboard device is different from the keyboard device 1 according to the present embodiment only in that a member corresponding to the key lower limit stopper 22 is formed by a relatively soft material (e.g. a felt), whereas a member corresponding to the hammer upper limit stopper 29 is formed by a relatively hard material (including e.g. a high-repulsion polyurethane foam). Note that in FIGS. 5A and 5B, right upward arrows indicate changes in the static load curves when the key 5 is pressed down, and left downward arrows indicate changes in the static load curves when the pressed down key 5 returns to their original key-released states.

As shown in FIG. 5A, in the example, when the key stroke of the pressed down key 5 reaches approximately 10 mm, the key depression load is steeply increased, and before the key stroke reaches approximately 11 mm, it has become impossible to press down the key 5. Note that the key depression load decreases after once increasing between 6 and 8 mm because after once the engagement protrusion 37*b* of the hammer 6 is engaged with the let-off member 33, the engagement thereof is released (let-off feeling).

On the other hand, as shown in FIG. 5B, in the comparative example, similar to the above-described example, when the key stroke of the pressed down key 5 reaches approximately 10 mm, the key depression load is steeply increased. However, when the depression of the key 5 is continued beyond the key stroke of 10 mm, the key 5 is pressed down to a position where the key stroke exceeds 11 mm.

From the above, the example shows that when the key stroke reaches 10 mm, the key 5 moves into contact with the key lower limit stopper 22, and immediately thereafter, the key reaches its lowest position, whereby the key stroke is stabilized. On the other hand, the comparative example shows that after the key stroke has reached 10 mm, the key 5 further sinks until the key stroke exceeds 11 mm (by a length a), and therefore a so-called sponge feeling is given as a touch feeling felt during key depression.

Figure 6:
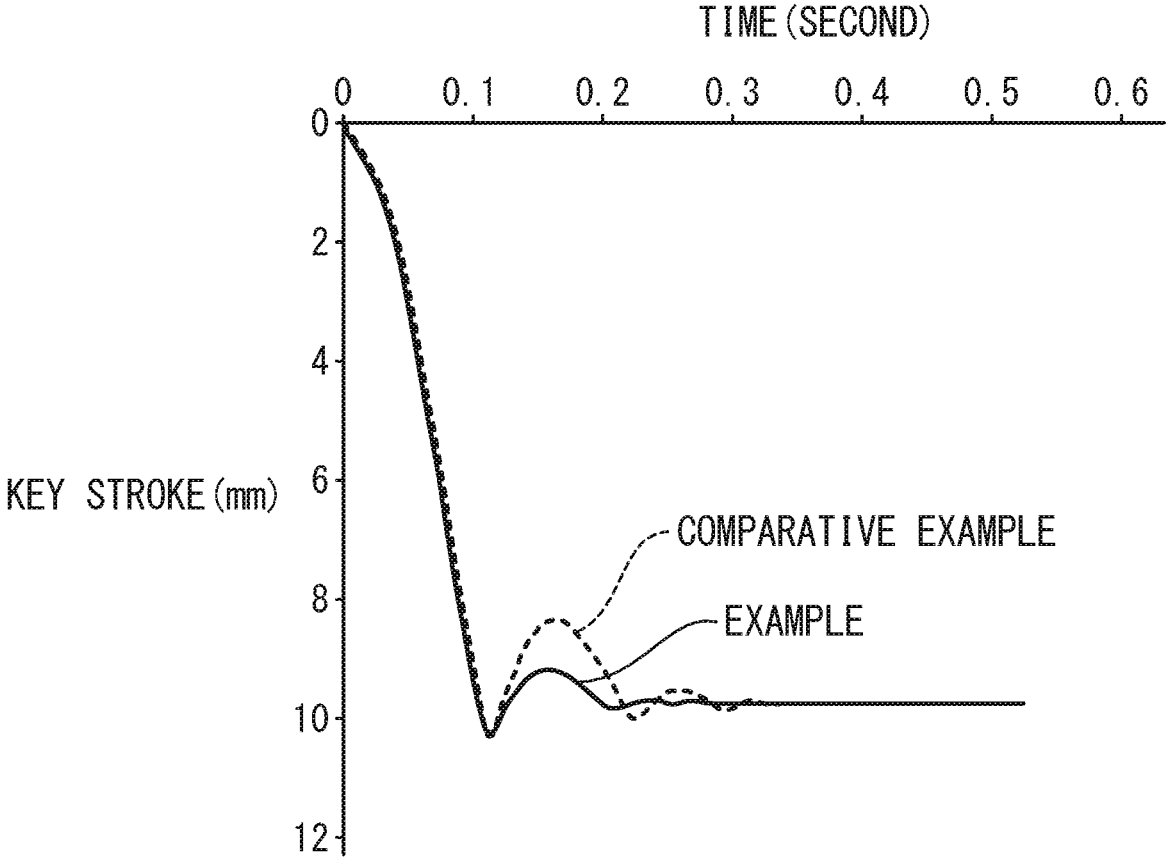
FIG. 6 is a diagram showing changes in key strokes in key depression tests in a state in which the example by the keyboard device according to the present embodiment and the comparative example by the above-described conventional keyboard device are superposed one upon the other.

FIG. 6 is a diagram showing changes in key strokes in key depression tests in a state in which the example in which the keyboard device 1 according to the present embodiment is used and the comparative example in which the above-described conventional keyboard device is used are superposed one upon the other. In each key depression test, a weight having a predetermined weight (e.g. 150 g) is freely dropped from a state close to a front end of an upper surface of the white key 3 in the key-released state to cause the changes in the key stroke.

As is clear from FIG. 6, in both of the example and the comparative example, after the key stroke has reached a position slightly exceeding 10 mm, an amplitude of the key stroke is progressively reduced to converge to approximately 10 mm. Further, immediately after the key stroke has exceeded 10 mm, the key stroke most largely changes as if bouncing. This change in the key stroke due to the bouncing is generated when a repulsive force generated by the contact of the hammer 6 with the hammer upper limit stopper 29 acts on the key 5 via the hammer 6. Therefore, as is clear from FIG. 6, in the example, the change in the key stroke due to the bouncing is made smaller than in the comparative example. From this, it is understood that vibration felt at a fingertip during depression of the key 5 can be more suppressed in the example than in the comparative example.

As described above in detail, according to the keyboard device 1 of the present embodiment, the hammer upper limit stopper 29 has a predetermined flexibility, i.e. a flexibility that allows deformation of the hammer upper limit stopper 29 itself such that after contact of the hammer 6 with the hammer upper limit stopper 29, the key 5 associated with the hammer reaches its lowest position in a state in contact with the key lower limit stopper 22. With this, during depression of the key 5, a strong repulsive force is prevented from acting on the hammer 6 brought into contact with the hammer upper limit stopper 29, whereby differently from the conventional keyboard device, no repulsive force from the hammer 6 is transmitted to the key 5 by the key depression, and therefore, the key 5 can be firmly pressed down to the lowest position in the state in contact with the key lower limit stopper 22. As a consequence, the sponge feeling or unpleasant vibration as given by the conventional keyboard device is not given to a player.

Further, the key lower limit stopper 22 is formed to be harder than the hammer upper limit stopper 29, and the depressed key 5, irrespective of a magnitude of a key depression force for depressing the key, always reaches the lowest position in a state where the front end thereof is in contact with the key lower limit stopper 22. As described above, the key 5 that has reached the lowest position by key depression does not pivotally move further downward, and the key stroke of the key 5 is held constant. As described heretofore, according to the keyboard device 1 of the present embodiment, when the key 5 is depressed, it is possible to obtain an excellent touch feeling and a stable key stroke without giving the above-mentioned sponge feeling or unpleasant vibration to the player.

Note that the present invention is not limited to the above-described embodiment, but it can be practiced in various forms. For example, although in the above-described embodiment, the description is given of a case where the key body 3*a* of the white key 3 is brought into contact with the key lower limit stopper 22 by key depression, by disposing a key lower limit stopper with which the key body 4*a* of the black key 4 moves into contact, at a proper predetermined location of the keyboard chassis 2, it is possible to obtain the same advantageous effects as obtained by depressing the white key 3.

Further, although in the above-described embodiment, by setting the boundary value with reference to which whether the key striking is the soft key striking or the medium key striking is determined, to 300 g, the maximum value of the key depression force by the soft key striking is set to 300 g, this maximum value is not limited to this, but a force which is equal to or smaller than a force required to produce sound with a loudness indicated by a dynamic marking of p (piano) used in general performance of a piano as a musical instrument may be determined as the soft key striking.

Further, details of the constructions of the keyboard chassis 2, the keys 5, the hammers 6, the key lower limit stopper 22, and the hammer upper limit stopper 29 of the keyboard device 1 shown in the embodiment are given only by way of example, and they can be changed as appropriate within the scope of the subject matter of the present invention.

It is further understood by those skilled in the art that the foregoing are preferred embodiment of the invention, and that various changes and modifications may be made without departing from the spirit and scope thereof.

What is claimed is:

1. A keyboard device for a keyboard instrument, comprising:

a keyboard chassis;

a plurality of keys each extending in a front-rear direction and having a rear end pivotally supported on the keyboard chassis, the keys being arranged side by side in a left-right direction;

a plurality of hammers each extending in the front-rear direction and swingably supported on the keyboard chassis below the plurality of keys in association with the respective keys, the hammers being arranged side by side in the left-right direction, each for imparting a touch weight to an associated one of the keys while swinging in a manner interlocked with depression of the associated key;

a hammer upper limit cushion provided on a rear end of the keyboard chassis in a manner protruding downward therefrom above the plurality of hammers, the hammer upper limit cushion being contacted, in accordance with depression of one of the keys, from below by a rear end of one of the hammers, which is associated with the depressed key; and a key lower limit cushion provided on a front end of the keyboard chassis, the key lower limit cushion being contacted in accordance with the depression of the one of the keys, from above by a front end of the depressed key, wherein the hammer upper limit cushion is configured to have a predetermined flexibility that allows deformation of the hammer upper limit cushion itself such that after the hammer associated with the depressed key has been brought into contact with the hammer upper limit cushion by key depression, the key associated with the hammer reaches its lowest position in a state in contact with the key lower limit cushion, and wherein the key lower limit cushion is formed to be harder than the hammer upper limit cushion.

2. The keyboard device according to claim 1, wherein each of the plurality of keys is configured such that also when the key is depressed with a key depression load that is equal to or smaller than a predetermined value and allows the hammer associated with the key to swing, the depressed key reaches its lowest position in the state in contact with the key lower limit cushion.

3. The keyboard device according to claim 2, wherein the predetermined value is 300 g.

4. The keyboard device according to claim 1, wherein the hammer upper limit cushion is formed of a low-repulsion polyurethane foam mounted on the keyboard chassis and a felt provided on a lower surface of the low-repulsion polyurethane foam, and is provided such that the hammer upper limit cushion extends in the left-right direction along an entirety of the plurality of hammers, and wherein the key lower limit cushion is formed of a high-density polyurethane foam mounted on the keyboard chassis and a felt provided on an upper surface of the high-density polyurethane foam, and is provided such that the key lower limit cushion extends in the left-right direction along an entirety of the plurality of keys.

* * * * *